US005815948A

United States Patent [19]

Dzielak

[11] Patent Number: 5,815,948

[45] Date of Patent: Oct. 6, 1998

[54] WATERPROOF GAITER

[76] Inventor: James E. Dzielak, 146 Powderly St., Carbondale, Pa. 18407

[21] Appl. No.: 796,244

[22] Filed: Feb. 7, 1997

Related U.S. Application Data

[60] Provisional application No. 60/015,961 Apr. 24, 1996.

[51] Int. Cl.[6] ..... A41D 17/00

[52] U.S. Cl. ..... 36/2 R; 36/1.5; 2/22; 2/242

[58] Field of Search ..... 36/1.5, 2 R; 2/22, 2/23, 24, 231, 242

[56] References Cited

U.S. PATENT DOCUMENTS

| | | | |
|---|---|---|---|
| D. 120,887 | 6/1940 | Grezlak | 36/2 R |
| 1,222,737 | 4/1917 | Dahlin | 36/2 R |
| 1,367,860 | 2/1921 | Chamberlin | 36/2 R |
| 1,835,695 | 12/1931 | Crocker | 36/2 R |
| 3,128,565 | 4/1964 | Graham et al. . | |
| 3,477,147 | 11/1969 | Bauer . | |
| 4,001,953 | 1/1977 | Fugere et al. . | |
| 4,856,207 | 8/1989 | Datson . | |
| 5,005,215 | 4/1991 | McIlquham . | |
| 5,170,503 | 12/1992 | Hightower, Jr. et al. . | |
| 5,249,375 | 10/1993 | Tabarly . | |

FOREIGN PATENT DOCUMENTS

| | | | |
|---|---|---|---|
| 329621 | 8/1989 | European Pat. Off. | 36/2 R |
| 2475376 | 8/1981 | France | 36/2 R |
| 2539276 | 1/1983 | France . | |
| 288366 | 10/1915 | Germany | 36/2 R |
| 31575 | 1/1905 | Switzerland | 36/2 R |

*Primary Examiner*—Paul T. Sewell
*Assistant Examiner*—Anthony Stashick
*Attorney, Agent, or Firm*—Richard C. Litman

[57] ABSTRACT

A pair of gaiters, each gaiter having a waterproof neoprene member with opposing top and bottom portions, front and back surfaces, and a seam running lengthwise from the top to the bottom. Each gaiter also has a nylon interior and exterior disposed about the back and front surfaces, respectively, and running lengthwise from the top of the sleeve to the bottom of the sleeve. The neoprene member, the interior, and the exterior define an open-ended sleeve having a frontside and a backside. The gaiters also include a first cinching structure at the top of the sleeve for enclosing the neoprene gaiter around the user's knee region, and a second cinching structure at the bottom of the sleeve for enclosing the neoprene gaiter around the user's ankle region. The first and second cinching structures allow the user to easily slip on and off the neoprene gaiter in order to prevent water, snow, dirt, or mud from entering into the user's boot or shoe. Furthermore, the first and second cinching structures provide waterproof and other protection to the user's lower leg region.

14 Claims, 3 Drawing Sheets

WATERPROOF GAITER

CROSS-REFERENCE TO RELATED APPLICATION

This application claims the benefit of U.S. Provisional patent application Ser. No. 60/015,961, filed Apr. 24, 1996.

BACKGROUND OF THE INVENTION

1. Field of the Invention

The present invention relates generally to gaiters, and more particularly to waterproof gaiters which slip easily on and off the user's legs, as well as prevent entry of water, snow, dirt, or mud from entering into the user's boots or shoes.

2. Description of Prior Art

While walking through wet and swampy ground or through shallow river beds or streams or even in a rainstorm, it is always desirable to prevent water, dirt, or mud from entering into the user's boots or shoes, as well as keep the shin areas dry. Furthermore, while walking through heavy brush, deep snow, and dew-soaked vegetation, it is desirable to shield the calves, ankles, and knee region from both water and other uncomfortable external elements, as well as from insects. It is for these reasons that many attempts have been made to protect the user's lower leg areas while walking outdoors.

Examples of such protective devices against insects, snakes, and even humans include U.S. Pat. Nos. 3,128,565 issued Apr. 14, 1964, to Graham et al.; 4,001,953 issued Jan. 11, 1977, to Fugere et al.; 5,005,215 issued Apr. 9, 1991, to McIlquham; and 5,170,503 issued Dec. 15, 1992, to Hightower, Jr. et al. Graham et al. discloses both a boot and a gaiter made of a resinous plastic material used generally by hunters. However, the boot and gaiter disclosed by Graham et al. does not suggest a totally waterproof device. Fugere et al. discloses a protective gaiter having a length running from the instep to just below the knee of the user, wherein the gaiter has nylon front and liner panels and a back panel, dimensioned and configured to form a pocket which contains an energy-absorbing pad. The device disclosed by Fugere et al. is a shin guard used by soccer players and is not considered to be waterproof. McIlquham discloses a protective article of clothing having a circumferential flap and an absorbent strip, wherein the article of clothing runs from the user's waist to the top of the user's ankle. The device disclosed by McIlquham provides the user protection against insects, while failing to be waterproof. Hightower, Jr. et al. discloses a legging made of a novel woven fabric secured to the user's body by velcro or by other suitable closures. The device disclosed by Hightower, Jr. et al. is a snake chap and not waterproof.

Other examples of the prior art attempts made in order to protect the user's lower leg area which are generally considered to be waterproof include U.S. Pat. Nos. 3,477,147 issued Nov. 11, 1969, to Bauer; 4,856,207 issued Aug. 15, 1989, to Datson; and 5,249,375 issued Oct. 5, 1993, to Tabarly; and French Publication Number 2,539,276 deposited Jan. 14, 1983, by Schmeltz.

Bauer discloses both a shoe and a gaiter which are made of a rain and weatherproof, repellent material, such as sheet plastic, and a cold weather liner. Bauer teaches securing the shoe and gaiter together by a zipper and epoxy, and securing the shoe and gaiter combination about the body by a cord at the top and bottom of the combination. Bauer's device is expensive and complicated to manufacture due to the added components of epoxy, zipper, and cold weather liner.

Datson discloses a permanently affixed boot and gaiter combination made of a laminate of micro-porous polytetraflouroethylene sheet sandwiched between two sheets of woven material, wherein the gaiter has a tubular shaped gusset designed to keep water out. Datson suggests securing the boot and gaiter combination to the leg area by using studs or velcro, and suggests securing the boot and gaiter together by stitching and sealing or employing waterproof cement. With Datson's device, the user is incapable of merely interchanging the gaiter with any other shoe because Datson teaches making a permanent combination of gaiter and shoe. Furthermore, Datson's device is expensive to manufacture due to the use of the micro-porous polytetraflouroethylene sheet material.

Schmeltz discloses a waterproof material having a primary and secondary sleeve designed to enclose the knee region of the user by a drawstring and the ankle region of the user by an elastic band. The primary sleeve is permanently joined to the secondary sleeve in order to create an upper and lower part, wherein the permanent junction between the parts precludes the entrance of snow into a sock worn by a user. The Schmeltz device is generally considered to be used by snow skiers in deep powder which is designed to allot freedom of movement of the lower legs and is not considered to be designed to prevent mud from entering into one's shoe or to protect one's lower legs from vegetation.

None of the above inventions and patents, taken either singly or in combination, is seen to describe the instant invention as claimed. Thus, a waterproof gaiter solving the aforementioned problems is desired.

SUMMARY OF THE INVENTION

The present invention is a pair of gaiters, each gaiter having a waterproof neoprene member with opposing top and bottom portions, front and back surfaces, and a seam running lengthwise from the top to the bottom. Each gaiter also has a nylon interior and exterior disposed about the back and front surfaces, respectively, and running lengthwise from the top of the sleeve to the bottom of the sleeve. The neoprene member, the interior, and the exterior define an open-ended sleeve having a frontside and a backside. The gaiters also include a first cinching structure at the top of the sleeve for enclosing the neoprene gaiter around the user's knee region, and a second cinching structure at the bottom of the sleeve for enclosing the neoprene gaiter around the user's ankle region. The first and second cinching structures allow the user to easily slip on and off the neoprene gaiter in order to prevent water, snow, dirt, or mud from entering into the user's boot or shoe. Furthermore, the first and second cinching structures provide waterproof and other protection to the user's lower leg region.

Accordingly, it is a principal object of the invention to provide a user with a waterproof device for protecting one's lower leg region against the entrance of water, snow, dirt, or mud into the user's boots or shoes.

It is another object of the invention to provide a gaiter for protecting one's lower leg region from water, snow, dirt, mud, or vegetation and which gaiter is interchangeable with any type of boot or shoe.

It is a further object of the invention to provide a user with a relatively warm yet comfortable gaiter for protecting one's lower leg against the entrance of water, snow, dirt, or mud into the user's boot or shoes.

Still another object of the invention is to provide a simple and convenient device for protecting one's lower leg region to the ankle and knee regions.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
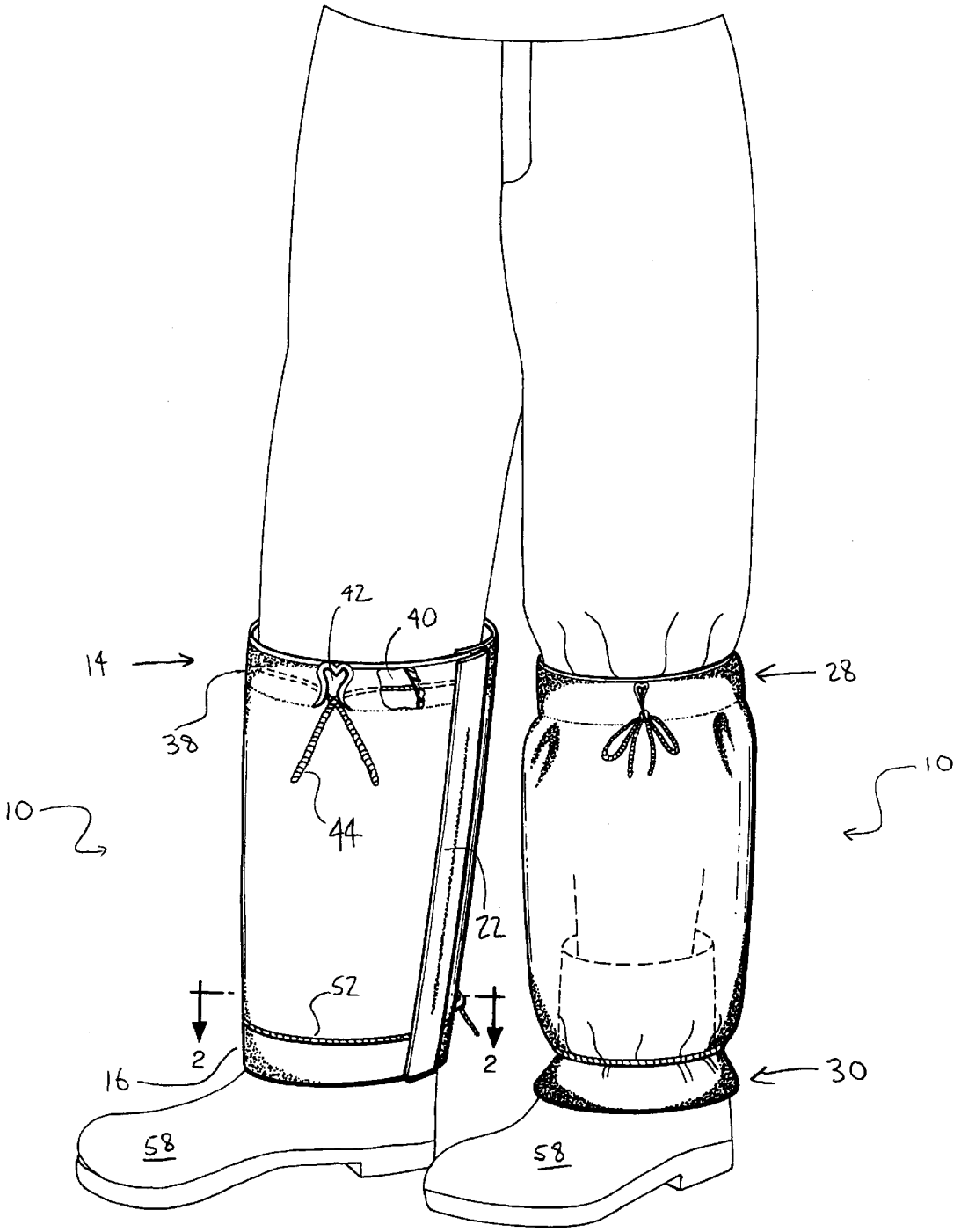
FIG. 1 is an environmental, perspective view of two identical neoprene gaiters constructed according to the present invention.
Figure 2:
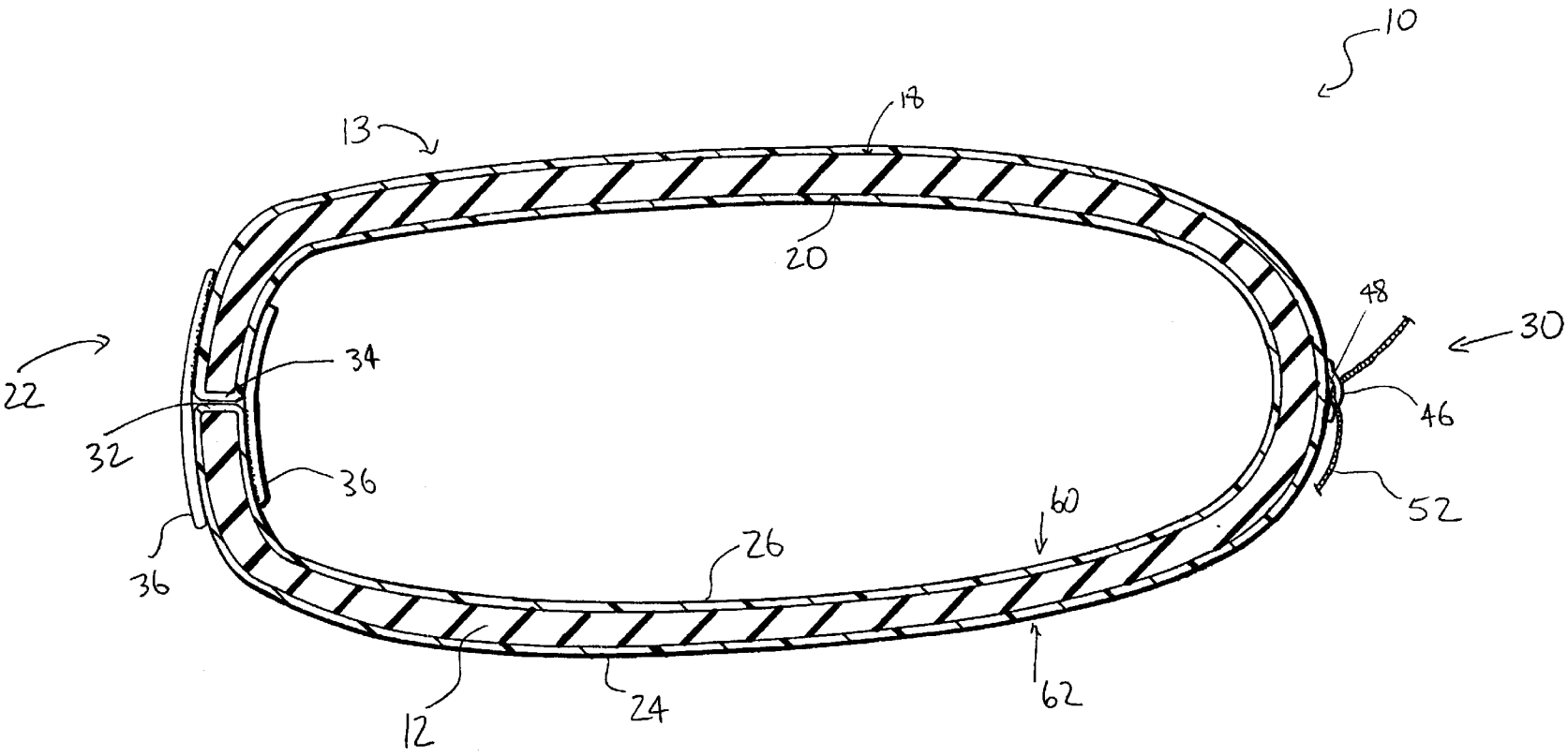
FIG. 2 is an enlarged cross-sectional view of a neoprene gaiter drawn along lines 2—2 of FIG. 1, according to a first embodiment of the present invention.
Figure 3:
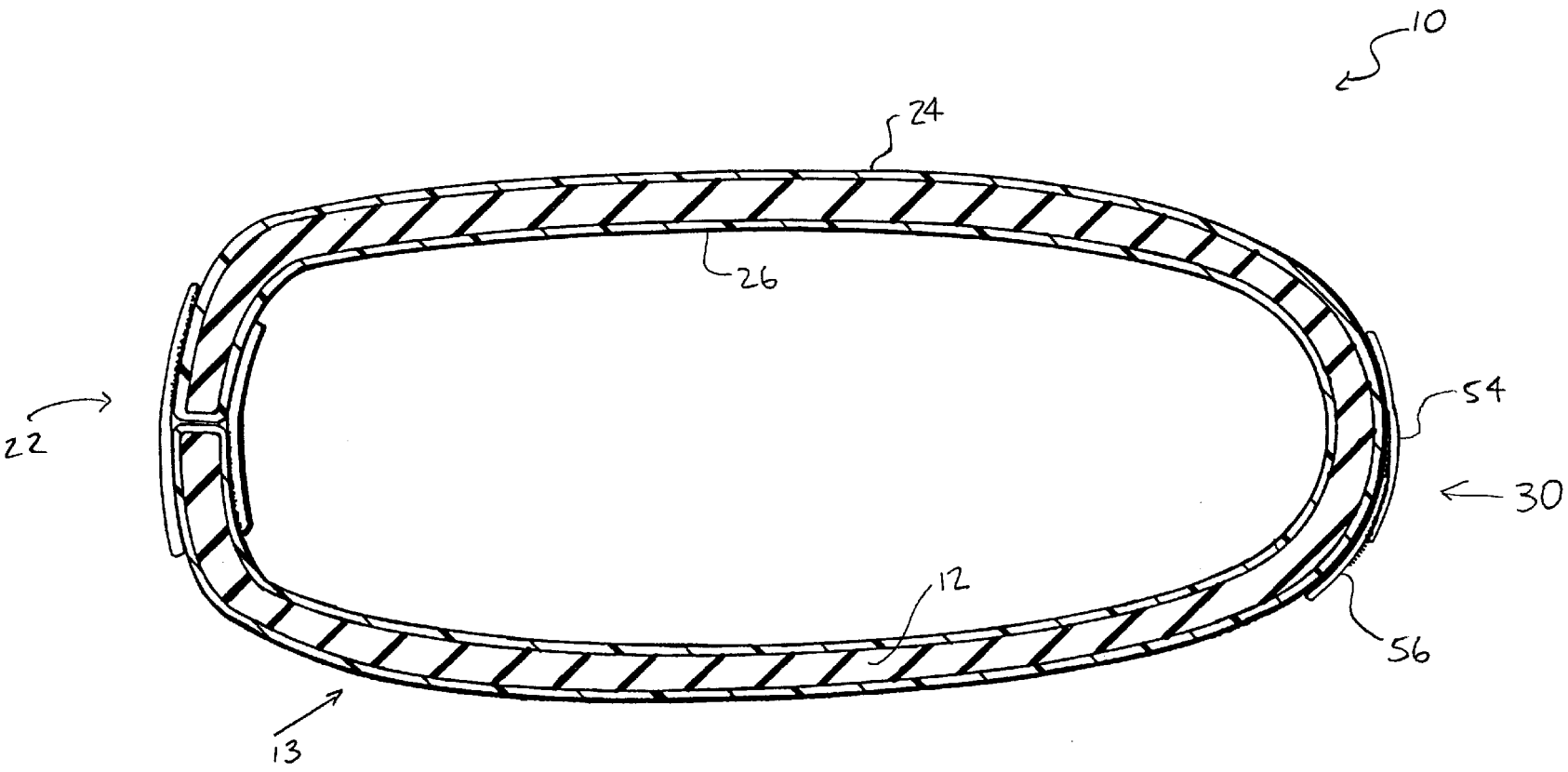
FIG. 3 is an enlarged scale, cross-sectional view of a neoprene gaiter according to the preferred embodiment of the present invention.

As can be seen in FIGS. 1–3, the present invention is a pair of gaiters, each gaiter 10 having a waterproof neoprene member 12 with opposing top 14 and bottom 16 portions, front 18 and back 20 surfaces, and a seam 22 running lengthwise from the top 14 to the bottom 16. Each gaiter 10 also has both a nylon interior 26 and exterior 24 disposed about the back 20 and front 18 surfaces, respectively, and running lengthwise from the top 14 of the sleeve 13 to the bottom 16 of the sleeve 13. The neoprene member 12, the interior 26, and the exterior 24 thus define an open-ended, triple-ply sleeve 13, having frontside 62 and backside 60.

The gaiters 10 also include a first cinching structure 28 at the top 14 of the sleeve 13 for enclosing the neoprene gaiter 10 around the user's knee region, and a second cinching structure 30 at the bottom 16 of the sleeve 13 for enclosing the neoprene gaiter 10 around the user's ankle region. The first and second cinching structures, 28 and 30 respectively, allow the user to easily slip the neoprene gaiter 10 on and off over the outside of the user's boot 58. Furthermore, the first and second cinching structures, 28 and 30 respectively, provide waterproof and other protection to the user's lower leg region above the boot.

In the preferred embodiment, the gaiter 10 is a waterproof triple-ply unit of three equally dimensioned members made up of a neoprene body 12 sandwiched between a nylon lining interior 26 and a nylon exterior 24. The gaiter 10 is formed by taking a rectangular shaped neoprene member 12 having a length of about fourteen to twenty two inches and a height of about twelve to twenty inches, and disposing two identically dimensioned nylon shells, 26 and 24, about the back 20 and front 18 surfaces, respectively. The preferred thickness of the neoprene member 12 should be between 3.0 and 4.0 mm (neoprene material having thicknesses outside of this range could, of course, be used).

To form the sleeve 13, the neoprene member 12 having the nylon interior 26 and exterior 24 is then folded lengthwise until the opposite edges 32, 34 abut one another to form a seam 22. This seam 22 should be triple glued together, and tape 36 should be applied to both sides of the seam 22 in order to define an open-ended sleeve 13 having a frontside 62 and a backside 60.

In the preferred embodiment, the first cinching structure 28 is formed by folding the top 14 of the sleeve 13 back onto itself to form a channel 38, thus defining an interior 40 and an opening 42 for inserting a drawstring 44. The channel 38 is secured to the backside 60 of the sleeve 13 by stitching and sealing, or the like. The second cinching structure 30 is formed when the bottom 16 of the sleeve 13 has a loop 46, preferably of leather or nylon, affixed proximate the heel portion of the boot 58, wherein the loop 46 defines a hole 48. A string 52 is inserted through the hole 38 such that the string 52 may be wrapped about the bottom 16 of the sleeve 13 and tied off over the boot. The loop 46 should be stitched to the heel portion of the boot 58 to form a tight passage such that once the string 52 is inserted into the hole 48, the loop 46 and the string 52 are frictionally engaged.

An alternative embodiment as shown in FIG. 3 includes modifying the second cinching structure 30 to include two complementary strips of hook and loop fastener, 54 and 56, attached to the backside 60 of the sleeve 13. The first strip 54 of FIG. 3 is one component of hook and loop fastener and the second strip 56 is the other component of hook and loop fastening material. In a similar manner, an alternative embodiment (not shown) includes having the first cinching assembly 28 made up of two strips of material, 54 and 56, attached to the frontside 62 of the sleeve 13. The first strip 54 has one component of hook and loop fastening material and the second strip 56 has the other component of hook and loop fastening material.

Regardless of the type of cinching structure 28, 30 employed, the construction of the neoprene gaiter 10 is relatively simple and inexpensive due to the materials employed in its construction. The materials employed are dependable and fully effective in accomplishing the intended purposes of the neoprene gaiter 10. It should be noted that a waterproof material other than neoprene may alternatively be used for the waterproof member 12 in the present invention.

In operation, the user inserts a boot 58 through the top 14 of the sleeve 13, pulling it up towards the knee region of the user until the bottom 16 of the sleeve 13 is proximate the ankle region of the user. In order to slip the sleeve 13 on, both the first and second cinching structures 28, 30 need to be in a non-tensioned state, as shown in FIG. 1 relative to the user's right leg. Preferably, the user should have a neoprene gaiter 10 which has a length equivalent to the distance between the user's ankle to just below the knee. Ideally, the user is wearing an 8" high work or hunting boot 58 such that the bottom 16 of the neoprene gaiter 10 substantially covers the top of the boot.

Since the neoprene gaiter 10 has a nylon interior 26, the low frictional qualities of the nylon allow a user to easily slip the sleeve 13 down over the boot 58. Similarly, the nylon interior 26 will aid the user in easily slipping off the neoprene gaiter 10. After putting on the gaiter, the user should then tighten the first and second cinching structures 28, 30 in order to enclose the neoprene gaiter 10 about the lower leg region, as shown in FIG. 1 relative to the user's left leg.

In order to tighten the first and second cinching structures 28, 30 according to the preferred embodiment, the user need simply tie together the drawstring 44 at the first cinching structure 28 and tie together the string 52 at the second cinching structure 30. Alternatively, if hook and loop fasteners are used as the cinching assembly 28, 30, then the user need simply fasten together the corresponding hook and loop fastening components.

Once the neoprene gaiter 10 is enclosed about the lower leg region, water, snow, dirt, or mud will be prevented from entering into the user's boot 58 (or shoe), and waterproof and other protection to the user's lower leg region will be provided. Furthermore, since the neoprene gaiter 10 can easily be slipped on and off any type of boot 58 and legging material donned by the user, the user is provided with an interchangeable gaiter for protecting the lower leg region without having to buy another unit of both a gaiter and a boot combination. In addition, since the neoprene member 12 has a thickness of approximately 3.0 to 4.0 mm., such a thickness provides the user with a relatively warm and insulating, yet comfortable, gaiter for protecting one's lower leg regions.

It is to be understood that the present invention is not limited to the embodiments described above, but encompasses any and all embodiments within the scope of the following claims.

I claim:

1. A waterproof gaiter comprising:

a waterproof member having an upper end and an opposing lower end, front and back surfaces, and a first edge and an opposing second edge;

an inner shell disposed about said back surface and extending from said upper end to said lower end of the waterproof member;

an outer shell disposed about said front surface and extending from said upper end to said lower end of the waterproof member;

a means for securely attaching said first edge to said second edge such that said waterproof member and said inner and outer shells define an open-ended sleeve having a top and bottom, said means for securely attaching comprises a triple glued seam and tape being taped over said seam on said front and back surfaces to prevent water penetration;

a first cinching means at said top of said sleeve for enclosing said top of said sleeve around a region proximate a knee of a user; and a second cinching means at said bottom of the sleeve for enclosing said bottom of said sleeve around a region proximate an ankle of the user, whereby the user may protect an area between the knee region and the ankle region from external elements once said gaiter is properly donned.

2. A waterproof gaiter as defined in claim 1 wherein said waterproof member is made of neoprene.

3. A waterproof gaiter as defined in claim 1 wherein said inner shell is made of nylon having low-coefficient of friction characteristics such that said gaiter may be more easily slipped on and off by the user.

4. A waterproof gaiter as defined in claim 1 wherein said outer shell is made of nylon fabric woven to have tear resistant characteristics.

5. A waterproof gaiter as defined in claim 1 wherein said first cinching means comprises:

a channel defined by folding over said top of said sleeve back onto itself and securing said channel against said inner shell, said channel having an interior portion and an opening; and a drawstring inserted through said opening and into said interior portion, whereby the user may draw said drawstring through said channel to prevent said gaiter from sliding down.

6. A waterproof gaiter as defined in claim 1 wherein said first cinching means comprises a first strip and a second strip of material attached to said front surface of said sleeve, wherein said first strip has one component of hook and loop fastening material and said second strip has the other component of hook and loop fastening material, whereby the user may prevent said gaiter from sliding down towards said lower end by detachably fastening together said hook and loop fastening material.

7. A waterproof gaiter as defined in claim 1 wherein said second cinching means comprises:

a loop affixed to said outer shell thereby defining a hole; and a string passing through said hole and of sufficient length to be wrapped about said lower end and tied, whereby said string is cinched about said lower end to prevent water, snow, dirt, or mud from entering into said lower end and into a boot member disposed about the ankle region.

8. A waterproof gaiter as defined in claim 7 wherein said loop is made of a material selected from the group consisting of nylon and leather.

9. A waterproof gaiter comprising:

an open-ended waterproof sleeve having a top and a bottom, a front surface and a back surface, and a seam extending lengthwise from said top to said bottom, said top being proximate to a knee region of a user, said bottom being proximate to an ankle region of the user, said seam being triple glued and covered on said front surface and said back surface of said sleeve with tape, whereby said gaiter has increased waterproof protection;

an interior disposed about said back surface and extending lengthwise from said top to said bottom;

an exterior disposed about said front surface and extending lengthwise from said top to said bottom;

a first cinching means at said top of said sleeve for enclosing said gaiter around the knee region; and a second cinching means at said bottom of said sleeve for enclosing said gaiter around the ankle region, whereby the user may easily slip on said gaiter in order to prevent water, snow, dirt, or mud from entering into said bottom and said top of said sleeve, as well as provide waterproof and other protection to an area of the user defined between the ankle and knee regions.

10. A waterproof gaiter as defined in claim 9 wherein said waterproof sleeve is made of neoprene.

11. A waterproof gaiter as defined in claim 9 wherein said interior and said exterior are made of nylon.

12. A waterproof gaiter according to claim 9 wherein said first cinching means comprises a channel having an interior portion and an opening for inserting a drawstring, said drawstring extending through said opening and into said interior portion, whereby the user may prevent said gaiter from sliding down towards the ankle region.

13. A waterproof gaiter as defined in claim 9 wherein said second cinching means comprises:

a loop affixed to said front surface of said bottom thereby defining a hole for passage of a string; and a string, said string being integrated into said loop by sewing thereto, wherein said string is wrapped about said bottom and tied off in order to prevent water, snow, dirt, or mud from entering into a boot member disposed about the ankle region.

14. A waterproof gaiter as defined in claim 9 wherein said second cinching means comprises a strip of material having opposite ends, wherein one of said ends has a first component of hook and loop fastening material and the other of said ends has a second component of hook and loop fastening material, whereby the user may prevent water, snow, dirt, or mud from entering into a boot member disposed about the ankle region by fastening together said hook and loop fastening material.

* * * * *